United States Patent [19]

Jarry et al.

[11] Patent Number: 4,775,334

[45] Date of Patent: Oct. 4, 1988

[54] MULTICONTACT CONNECTOR AND ELECTRICAL CONTACT FOR SAME

[75] Inventors: Alain Jarry, Le Mans; Paul Djian, Paris, both of France

[73] Assignee: Souriau & Cie, Boulogne Billancourt, France

[21] Appl. No.: 79,395

[22] Filed: Jul. 30, 1987

[30] Foreign Application Priority Data

Aug. 4, 1986 [FR] France ..... 86 11264

[51] Int. Cl.[4] ..... H01R 13/434

[52] U.S. Cl. ..... 439/745; 439/932

[58] Field of Search ..... 439/161, 733, 744, 745, 439/869, 871, 932, 82

[56] References Cited

U.S. PATENT DOCUMENTS 3,079,582 2/1963 Lazar ..... 439/871
3,801,954 4/1974 Dorrell ..... 439/161
4,497,527 2/1985 Cameron ..... 439/161
4,687,269 8/1987 Dubertret et al. ..... 439/161

FOREIGN PATENT DOCUMENTS 1640753 11/1970 Fed. Rep. of Germany ..... 439/744
941840 11/1963 United Kingdom ..... 439/744

*Primary Examiner*—Gil Weidenfeld
*Assistant Examiner*—Gary F. Paumen
*Attorney, Agent, or Firm*—Nixon & Vanderhye

[57] ABSTRACT

A multicontact electrical connector suitable for use in avionics, radar and industrial electronic control systems and devices comprises a plurality of electrical contacts each in the form of an electrically conductive contact body defining a shank, a retention area and an active part. The retention area forms a portion of reduced cross-section. A member made from a shape memory material is fitted to this retention area and is adapted to retain the contact in the connector.

10 Claims, 4 Drawing Sheets

MULTICONTACT CONNECTOR AND ELECTRICAL CONTACT FOR SAME

BACKGROUND OF THE INVENTION

1. Field of the Invention

The present invention concerns an electrical contact for a multicontact connector and a connector comprising such electrical contacts.

2. Description of the Prior Art

The multicontact connectors currently used and commercially distributed usually comprise, as shown in longitudinal cross-section in FIG. 1, a male part denoted A and a female part denoted B, the male and female contacts being disposed in respective insulative blocks 100A, 100B held in the male and female connector bodies. The connector shown in FIG. 1 is a round connector meeting the American specification MIL C 482 G.

To secure mechanical retention of the contacts in passageways 4 for them formed in the insulative blocks it is necessary to provide a fixing system comprising for each contact a locking clip 42 consisting of a spring metal tab. In order to lock each contact by means of the clip, the housing 4 must necessarily have an appropriate profile as seen in cross-section, as shown in FIG. 1, so as to provide in a chamber shoulders or wedging the corresponding clip and/or the contact against the latter.

This highly specific profile of each passageway at the level of the chamber results in a significant increase in the diameter of the passageway at this level, the effect of which is to limit the number of contacts for a given type of connector determined in particular by the minimal distance needed between two adjacent electrical contacts to obtain the required electrical isolation properties. Also, because of the complex profile of each passageway as previously described, insulative blocks provided with their housings being obtained by molding an electrically insulative plastics material, the molding can only be carried out in molds comprising molding pins to which are attached chemically degradable members having the exact dimensions of the required profile. The plastics material in liquid or paste form having flowed into the mold fitted with the previously described pins, after cooling and solidification of the insulative block it is then necessary to attack by chemical means the members attached to each molding pin in order to be able to release the insulative block from the mold and so recover the latter.

Although satisfactory, this procedure entails a large number of operational phases which are time-consuming and therefore costly. Also, because of the difficulty in ensuring that each attached member is chemically attacked in precisely the same way during the same operational period, the degradation of these parts may be more or less perfect, depending on the operating conditions at each molding pin, these conditions being related to the geometry and to the configuration of the insulative block provided with its passageways, imperfect degradation of the members attached to one or more molding pins leading to damage to one or more passageways on releasing the insulative block concerned. The insulative blocks featuring any such defects then have to be rejected with no possibility of recovering them.

An object of the present invention is to remedy all of the previously mentioned disadvantages by providing an electrical contact for multicontact connectors featuring a retention system whereby the electrical contact is retained essentially by friction rather than by wedging.

Another object of the invention is to provide a multicontact electrical connector in which, because of specific features of the system for retaining each contact, the diameter of the passageway for each electrical contact is at most substantially equal to the overall transverse dimension or diameter of the contact body, which makes it possible to increase the density of the contacts for a type of connector with fixed dimensions.

Another object of the invention is to procure, through the specific structure of the retention system, a very great simplification in the method of producing a connector comprising such contacts, the phase in which parts attached to the molding pins have to be degraded being eliminated or made relatively minor.

SUMMARY OF THE INVENTION

In one aspect, the present invention consists in an electrical contact for a multicontact connector comprising an electrically conductive contact body, a shank, a retention area and an active part on said electrically conductive contact body, of which said retention area forms a portion of reduced cross-section, and a member made from a shape memory material fitted to said retention area and adapted to retain said contact in a passageway in said connector.

In another aspect, the invention consists in a multicontact connector comprising a plurality of electrical contacts wherein each contact comprises an electrically conductive contact body, a shank, a retention area and an active part on said electrically conductive contact body, of which said retention area forms a portion of reduced cross-section, and a member made from a shape memory material fitted to said retention area and adapted to retain said contact in a respective passageway in said connector.

The invention is applicable to the manufacture of multicontact electrical connectors used in avionics, radar systems and, more generally, industrial electronic control and regulator systems.

The invention will be better understood from the following description given with reference to the appended drawings.

DESCRIPTION OF THE PREFERRED EMBODIMENTS

Figure 1:
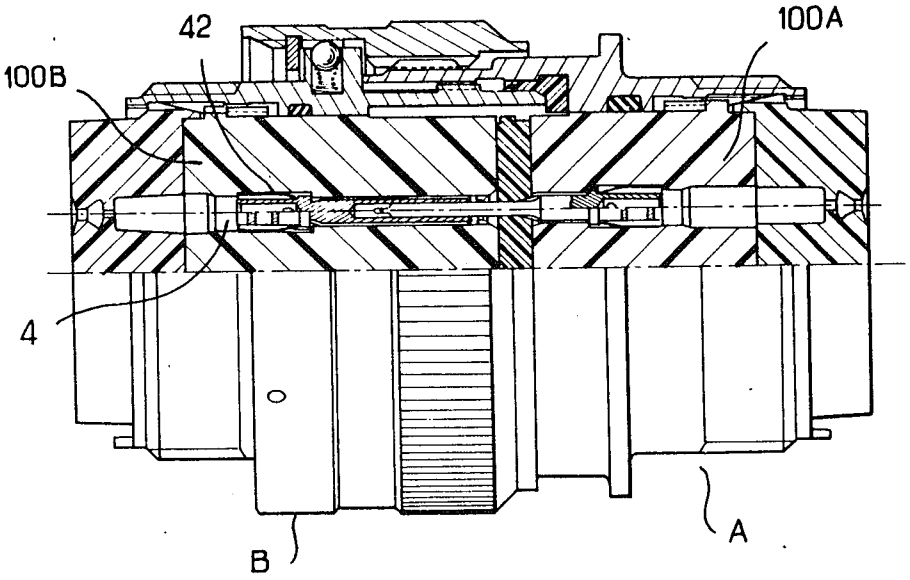
FIG. 1 relates to the prior art.
Figure 2A:
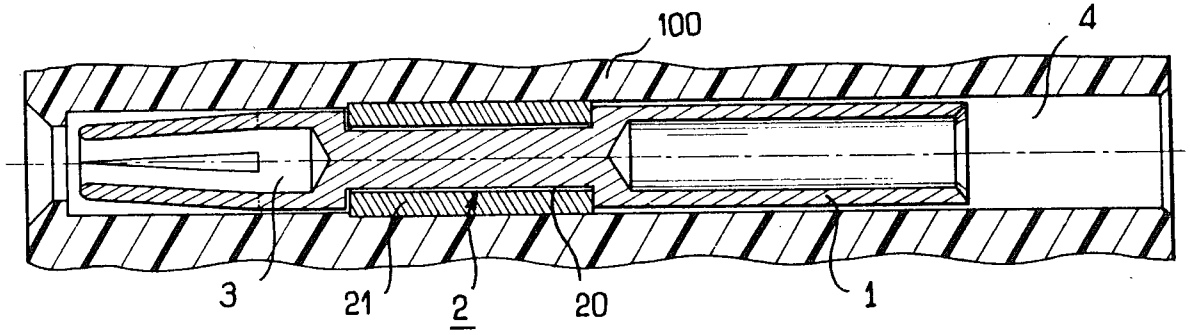
FIGS. 2*a*, 2*b* and 2*c* show in longitudinal cross-section various embodiments of an electrical contact in accordance with the invention.

An electrical contact for multicontact connectors in accordance with the invention will first be described with reference to FIG. 2*a*.

As seen in that figure, the electrical contact comprises a shank 1 into which the cable from the electrical connector may be inserted in order to procure the mechanical cohesion and the electrical connections between the electrical contact and the conductor of the cable to be connected. The electrical contact further comprises a retention area denoted 2 and an active part 3. The active part 3 may consist, for example and as shown in FIG. 2*a*, of a female socket adapted to receive the corresponding male part of a male electrical contact.

According to one particularly advantageous feature of the electrical contact in accordance with the invention, the shank 1, the retention area 2 and the active part 3 are all formed by an electrically conductive contact body, the retention area 2 being formed by a portion 20 of reduced cross-section. In accordance with one advantageous characteristic of the electrical contact in accordance with the invention, there is fitted over the reduced cross-section portion 20 a shape memory material member 21 adapted to secure retention of the contact in its passageway 4 when fitted thereto. In FIG. 2*a* the passageway 4 is shown formed in the insulative block 100 of the male or female part of the connector.

According to another advantageous characteristic of the electrical contact in accordance with the invention, the shape memory material member 21 is a sleeve. The member 21 is made so as to have a sufficient longitudinal dimension to exert in a first memorized shape state sufficient pressure on the walls of the passageway 4 to produce the necessary friction against these, the contact being locked into its housing in this way.

Figure 2B:
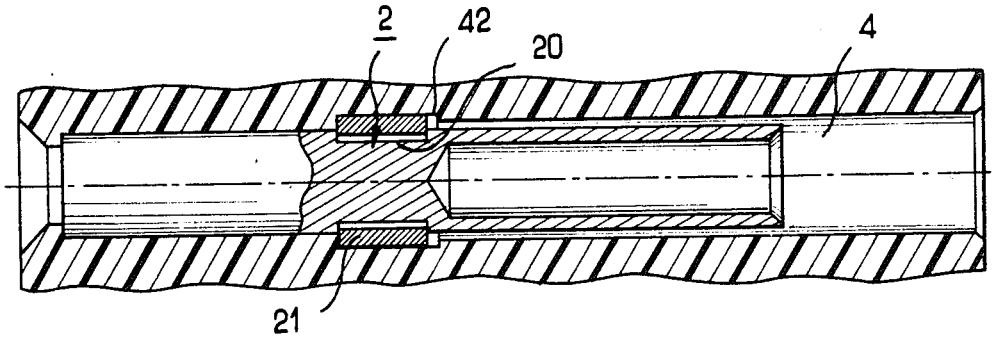

Naturally, as shown in FIG. 2*b* and in a non-limiting way, the longitudinal dimension of the sleeve 21 may be reduced. In this case a supplementary passageway 42 may be provided in the wall of the passageway 4 in the region of the reduced cross-section portion 20 of the electrical contact. In this case, depending on the nature of the material chosen, the passageway 42 may be made in such as way as to form shoulders on which the sleeve 21 bears in such a way as to wedge the electrical contact into its passageway 4. The shoulders formed in this way and the passageway 42 can in this way, and advantageously, consist of a step that is shallow as compared with the corresponding dimension of the electrical contact or of the contact body. Of course, in a general and non-limiting way, the electrical contact has been shown as consisting of a contact body of substantially circular cross-section.

In another non-limiting embodiment of the electrical contact (FIG. 2*c*) in accordance with the invention the sleeve 21 may have cut-out parts 210 adapted to lock the contacts relative to the wall of the passageway 4.

The shape memory material member 21 may advantageously be a material selected from the group comprising nickel-titanium, nickel-titanium-iron, copper-zinc-aluminum and copper-aluminum-nickel in the form of an intermetalic compound or an alloy.

Figure 3A:
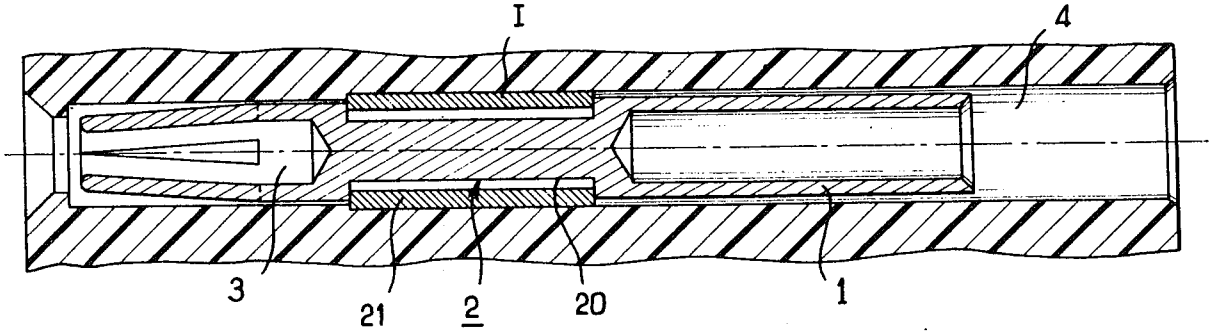
FIGS. 3*a* and 3*b* show the electrical contact from FIG. 2*a*, representing the various operating positions, the contact being in the situation of being inserted into or withdrawn from its passageway.

After a so-called educative process, the shape memory material member 21 is adapted to occupy reversibly a first memorized shape state denoted I in FIG. 3*a* in which the member 21 or the cut-out parts 210 thereof are in an expanded state. The member or the cut-out parts thereof thus project(s) relative to the contact body in order to enable retention of the contact in its passageway 4 after fitting. The shape memory material member 21 is adapted to occupy a second memorized state shape denoted II in which the member or the cut-out parts 210 thereof is (or are) retracted, the member thus being substantially withdrawn into the reduced cross-section portion 20 forming the retention area.

Figure 3B:
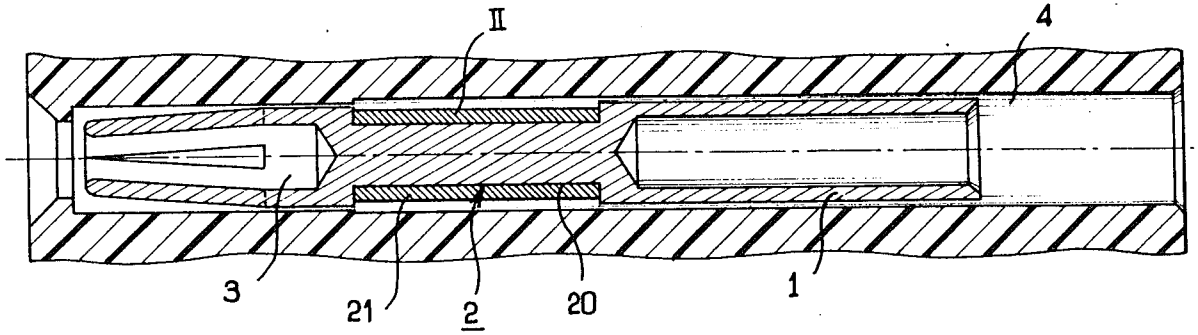

The second memorized state shape II is shown in FIG. 3*b*.

The change between the first memorized shape state I and the second memorized shape state II is achieved by varying only the temperature of the shape memory member 21 so that it lies either below or above the transition temperature Ms of its constitutive material. The contact or contacts of a particular connector can advantageously be brought to an end of martensitic state temperature corresponding to the memorized shape state II by lowering their temperature and in particular that of the shape memory member 21 using any cold source available in the industrial environment, such a source of liquid nitrogen. The shape memory member 21 in the martensitic state, which is the memorized shape state II of FIG. 3*b*, on returning to ambient temperature then changes to the memorized shape state I, all of the electrical contacts having been inserted into the corresponding housings in the insulative block beforehand. The memorized shape state I then corresponds to the martensitic crystalographic state in which a high force is applied by the shape memory member 21 to the wall of the passageway 4, thus enabling each contact to be held in its corresponding passageway. In this state the shape memory member or sleeve 21 makes it possible to apply to the wall of the passageway 4 a force or stress which is increased by a factor of at least two relative to a similar shape conventional type metal member, which enables appropriate retention of the contacts within their passageway.

To give a non-limiting example, the shape memory member 21 could advantageously be made from a substance comprising substantially 4%±0.5% aluminum, 27 to 29% zinc and the remainder copper. The percentages stated are atomic percentages. These percentages make it possible by a judicious choice of the various constituents to determine with a good degree of accuracy the transition temperature Ms of the alloy in question. The percentages indicated might correspond, for example to 4% aluminum, 28% zinc and the remainder copper to obtain a transition temperature Ms substantially equal to −80° C.

Also, the shape memory member 21 in the form of a sleeve or a sleeve comprising cut-out parts 210 undergoes an educative process, as already mentioned, before it is installed in the reduced cross-section area 20 of the contact. For a more detailed description of the educative processes that can be used to condition the shape memory member 21 of the electrical contact in accordance with the invention reference may advantageously be had to published European patent application No. 0 161 952 of Nov. 21, 1985. The educative process described in the aforementioned patent application make it possible to obtain shape memory sleeve members 21 that are able to change reversibly from the memorized shape state I to the memorized shape state II and vice versa simply by modifying the temperature of the shape memory member and/or the electrical contact comprising it.

Figure 2C:
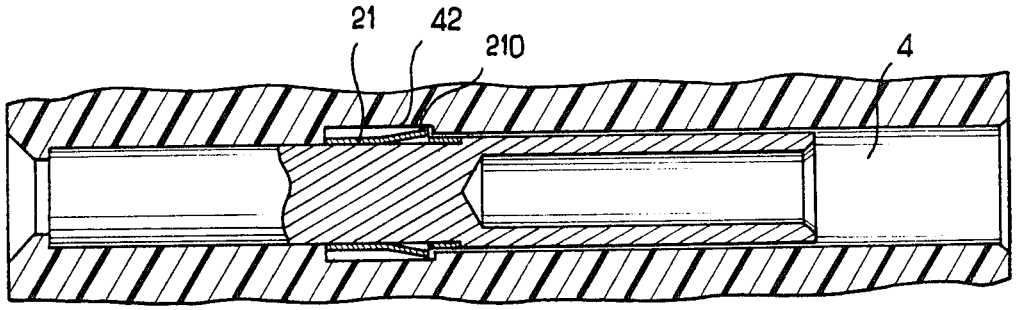

A more detailed description of a multicontact connector comprising a plurality of electrical contacts as described in relation to FIGS. 2*a*, 2*b* and 2*c* will now be given with reference to FIGS. 4*a* and 4*b*.

Figure 4A:
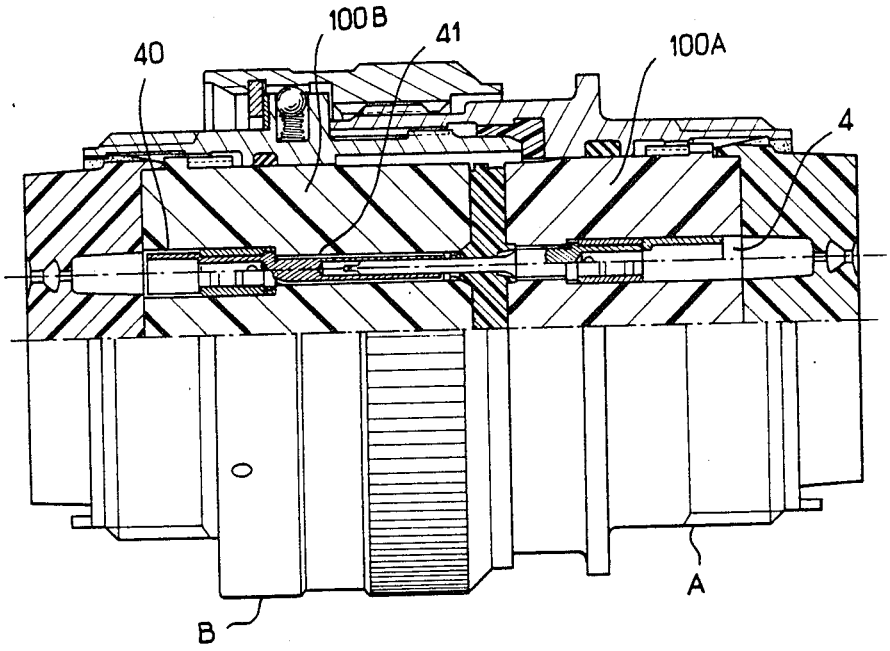
FIGS. 4*a* and 4*b* respectively show in partial cross-section a round multicontact connector comprising electrical contacts as shown in FIGS. 2*a* through 2*c* and in cross-section an insulative block and a contact passageway during the operational phase of molding the latter.

As shown in the aforementioned FIG. 4*a* the connector comprises a plurality of electrical contacts as previously described. As is also seen from FIG. 4*a* because of the higher force or stress exerted by the shape memory member 21, as compared with the prior art devices, the shoulders or housings adapted to receive the retaining device being eliminated or very much reduced, the passageways 4 of the insulative material blocks of the male part A or the female part B of the connector comprise at most two coaxial cylindrical passageways of different diameter denoted 40 and 41, forming a shallow shoulder. Given the reduction in the transverse dimension of the aforementioned housings, this makes it possible to increase the density of the contacts for a type of connector of fixed size. For round connectors meeting the previously mentioned specification MIL C 26 484 G, comprising 32 electrical contacts 1.06 mm in diameter, it has proved possible to increase the number of contacts to substantially 70 whilst adhering to the specification in respect of electrical isolation between the various electrical contacts constituting the connector. Thus, given the significant increase in the number of contacts for a connector of specific size, it is also possibly by assigning more than one contact per electrical connection to obtain a significant increase in the corresponding electrical current rating.

Figure 4B:
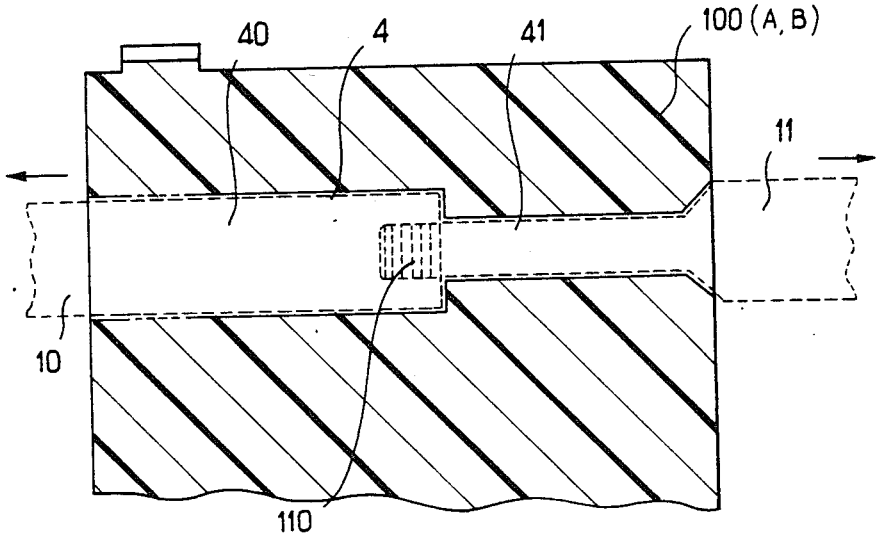

As is seen in FIG. 4*b*, the insulative material block 100 of the male parts A and the female parts B are molded, the corresponding passageways 4 being obtained by molding the insulative material in a mold comprising molding pins denoted 10, 11 having the same shape and size as the passageways 4. In FIG. 4*b* the molding pins 10, 11 are shown in dashed outline and the aforementioned molding pins can be separated at the level of their common part 110 for removal in the respective directions shown by the arrows. In the FIG. 4*b* embodiment it will be noted, of course, that because of the absence of any passageway to receive the shape memory member constituting the retaining device for each electrical contact, the method of manufacturing the insulative blocks 100 is especially simplified by the elimination of the phase involving chemical attack of parts attached to the molding pins, as these are not used. Of course, in the embodiment corresponding to the electrical contacts of FIGS. 2*b* and 2*c* in which a passageway with a shallow shoulder is provided, parts attached to the molding pins could be used. In this case these attached parts are of small size and the chemical attack phase can be considerably reduced, particularly in terms of duration, because of the shorter dissolving time.

There has been described herein an electrical contact provided with a retention system offering particularly high performance in terms of inherent retention properties. Also, the electrical contact in accordance with the invention is of particular benefit in that it makes it possible to design new type electrical connectors, by which is meant electrical connectors able to contain a much larger number of contacts than existing connectors with the same outside dimensions.

Furthermore, and and in a particularly advantageous way, because of the actual structure of the electrical contacts in accordance with the invention the method of manufacturing electrical connectors comprising such contacts is particularly simplified, the reliability of the resulting connectors also being increased.

There is claimed:

1. Electrical contact for a multicontact connector comprising an electrically conductive contact body, a shank, a retention area and an active part on said electrically conductive contact body, of which said retention area forms a portion of reduced cross-section, and a member made from a shape memory material fitted to said retention area and adapted to retain said contact in a passageway in an insulative block in said connector, said shape memory material is adapted to reversibly assume, and after an educative process, a first state in which said shape memory material member is expanded whereby it projects relative to said contact body to enable retention of said contact in said passageway and a second state in which said shape memory material member is retracted whereby it is substantially withdrawn into said retention area;

wherein changes between said first and second states are brought about exclusively by changing the temperature of said shape memory material member so that it lies either above or below the transition temperature of said shape memory material.

2. Contact according to claim 1, wherein said shape memory material member is a sleeve.

3. Contact according to claim 2, wherein said sleeve comprises cut-out portions adapted to contact against a wall of said passageway for said contact in said connector.

4. Contact according to claim 1, wherein said shape memory material is selected from the group comprising nickel-titanium, nickel-titanium-iron, copper-zinc-aluminum and copper-aluminum-nickel in the form of an intermetallic compound or an alloy.

5. Multicontact connector comprising a plurality of electrical contacts wherein each contact comprises an electrically conductive contact body, a shank, a retention area and an active part on said electrically conductive contact body, of which said retention area forms a portion of reduced cross-section, and a member made from a shape memory material fitted to said retention area and adapted to retain said contact in a respective passageway in an insulative block in said connector;

wherein said shape memory material is adapted to reversibly assume, and after an educative process, a first state in which said shape memory material member is expanded whereby it projects relative to said contact body to enable retention of said contact in said passageway and a second state in which said shape memory material member is retracted whereby it is substantially withdrawn into said retention area;

wherein changes between said first and second states are brought about exclusively by changing the temperature of said shape memory material so that it lies either above or below the transition temperatue of said shape memory material.

6. Connector according to claim 5, wherein said shape memory material member is a sleeve.

7. Connector according to claim 6, wherein said sleeve comprises cut-out portions adapted to lock said contact against a wall of said passageway for said contact in said connector.

8. Connector according to claim 5, wherein said shape memory material is selected from the group comprising nickel-titanium, nickel-titanium-iron, copper-zinc-aluminum and copper-aluminum-nickel in the form of an intermetallic compound or an alloy.

9. Connector according to claim 5, comprising an insulative material body in which are formed the respective passageways for each of said contacts, wherein each housing comprises at most two coaxial cylindrical passageways with different diameters defining a shallow shoulder.

10. Connector according to claim 9, wherein said insulative material body is made by molding pins having the size and shape of said passageways and adapted to form said passageways in said molded insulative material body.

* * * * *